US008581521B2

(12) United States Patent
Welten et al.

(10) Patent No.: US 8,581,521 B2
(45) Date of Patent: Nov. 12, 2013

(54) METHOD OF CONFIGURING AN LED DRIVER, LED DRIVER, LED ASSEMBLY AND METHOD OF CONTROLLING AN LED ASSEMBLY

(75) Inventors: Petrus Johannes Maria Welten, Oss (NL); Marc Saes, Eindhoven (NL)

(73) Assignee: EldoLAB Holding B.V., Eindhoven (NL)

( * ) Notice: Subject to any disclaimer, the term of this patent is extended or adjusted under 35 U.S.C. 154(b) by 259 days.

(21) Appl. No.: 13/129,674

(22) PCT Filed: Nov. 17, 2009

(86) PCT No.: PCT/NL2009/000219

§ 371 (c)(1), (2), (4) Date: May 17, 2011

(87) PCT Pub. No.: WO2010/056112

PCT Pub. Date: May 20, 2010

(65) Prior Publication Data

US 2011/0248644 A1 Oct. 13, 2011

Related U.S. Application Data

(60) Provisional application No. 61/115,528, filed on Nov. 17, 2008, provisional application No. 61/221,927, filed on Jun. 30, 2009.

(51) Int. Cl.
*H05B 37/00* (2006.01)

(52) U.S. Cl.
USPC ..... 315/312; 315/113; 315/185 R; 315/297

(58) Field of Classification Search
USPC ..... 315/151, 152, 192, 250, 185 R, 291, 315/294, 297, 308, 312; 362/231, 249.06
See application file for complete search history.

(56) References Cited

U.S. PATENT DOCUMENTS

| | | | | |
|---|---|---|---|---|
| 7,646,029 | B2 * | 1/2010 | Mueller et al. | 257/84 |
| 2006/0022214 | A1 | 2/2006 | Morgan et al. | |
| 2007/0244366 | A1 | 10/2007 | Murata | |
| 2008/0116818 | A1 * | 5/2008 | Shteynberg et al. | 315/192 |
| 2008/0136356 | A1 * | 6/2008 | Zampini et al. | 315/308 |
| 2009/0085500 | A1 * | 4/2009 | Zampini et al. | 315/297 |
| 2010/0081375 | A1 | 4/2010 | Rosenblatt et al. | |
| 2011/0137757 | A1 * | 6/2011 | Paolini et al. | 705/27.1 |
| 2011/0148685 | A1 * | 6/2011 | Welten | 341/176 |
| 2012/0187845 | A1 * | 7/2012 | Saes et al. | 315/113 |
| 2012/0188052 | A1 | 7/2012 | Rosenblatt et al. | |

FOREIGN PATENT DOCUMENTS

| | | |
|---|---|---|
| EP | 1 411 750 A2 | 4/2004 |
| EP | 1 750 486 A1 | 2/2007 |

* cited by examiner

*Primary Examiner* — Vibol Tan
(74) *Attorney, Agent, or Firm* — Hoffmann & Baron, LLP

(57) ABSTRACT

A method of configuring an LED driver is disclosed. The LED driver being arranged to provide a supply current to an LED fixture comprising a plurality of LEDs. The method comprises: identifying the LED fixture (LF)1 sending via a communication network (NTW) a configuration request to a configuration database (DB), receiving configuration data from the configuration database; and configuring the LED driver (LPS) according to the configuration data.

26 Claims, 4 Drawing Sheets

METHOD OF CONFIGURING AN LED DRIVER, LED DRIVER, LED ASSEMBLY AND METHOD OF CONTROLLING AN LED ASSEMBLY

CROSS-REFERENCE TO RELATED APPLICATIONS

This application is the National Stage of International Application No. PCT/NL2009/000219, filed Nov. 17, 2009, which claims the benefit of U.S. Provisional Application Nos. 61/115,528, filed Nov. 17, 2008, and 61/221,927, filed Jun. 30, 2009, the contents of which are incorporated by reference herein.

FIELD OF THE INVENTION

The invention relates to a method of configuring an LED driver, an LED driver, an LED assembly and a method of controlling an LED assembly.

BACKGROUND OF THE INVENTION

In the field of LED illumination technology, a variety of products are on the market today. In order to provide an illumination solution for a given application, an installer selects one or more LED assemblies (each comprising a plurality of light emitting diodes (LEDs)) as well as one or more LED drivers in order to drive the LEDs under appropriate electrical conditions. An LED assembly can also be referred to as an LED engine. In order to have an LED driver (an LED driver in general comprising a power converter for providing a supply power and a control unit for controlling the power converter and/or an LED fixture) drive a particular LED fixture under appropriate electrical conditions, such as LED current, duty cycle, color, maximum power dissipation, etc., the configuration of the LED driver is required.

Given the different types of LED assemblies and the different types of LED power supplies (or power converters), installation appears to be prone to errors, which may result in incorrect light output or even damaging of the LED fixture and/or the LED driver, due to exceeding a maximum current, maximum duty cycle, maximum power dissipation etc. of the LED fixture and/or the LED driver. Configuration of the LED driver may be performed usually by providing configuration parameters (expressed e.g. in the form of digital data) to it.

Whether due to a defective or invalid installation causing a light output which differs from a user's expectations, an incorrect configuration of the LED driver may result in additional cost, additional installation time, waste of valuable resources by damaging power supplies and/or LED assemblies, etc.

In addition, in known applications, the response of an LED assembly to an input signal (e.g. provided via a user interface) is predetermined, i.e. the control unit of the LED assembly being arranged to interpret an input signal in a certain way and control, based on the input signal, the power converter and/or the LED fixture in a certain way.

Such a predetermined behaviour of the control unit may however render the control unit unsuitable to adjust to changes implemented in e.g. the LED fixture, the power converter or the input signal or when a different response is required/desired by a user. In addition, such a predetermined behaviour may limit the application of the control unit in a dynamic environment e.g. to control an LED assembly having a modular product concept. Over the life-time of the control unit, it may be desirable or required to replace or upgrade certain components or modules of the LED assembly or (modular) lighting system that is being controlled. Such modules can e.g. comprise an LED or LED unit or a power converter.

SUMMARY OF THE INVENTION

In view of the above, it is an object of the invention to provide an improved way of configuring an LED driver.

Yet another object of the present invention is to provide an LED driver applicable in an LED assembly which is better adjusted to adapt to varying user requirements or changes to the LED assembly.

According to a first aspect of the invention, there is provided a method of configuring an LED driver, the LED driver to provide a supply power to an LED fixture comprising a plurality of LEDs, the method comprising:

- identifying the LED fixture;
- obtaining, using the identification of the LED fixture, configuration data for the LED driver from a configuration database; and
- configuring the LED driver according to the configuration data.

In a first step of the method of configuring an LED driver, an identification of an LED fixture is established. Such an identification can readily be available on the LED fixture or package of the LED fixture. Such an identification may e.g. be of a commercial nature, e.g. a manufacturers name and/or serial number or may as an alternative or in addition be of a more technical nature e.g. describing voltage/current requirements of the fixture. The information enabling the identification of the LED fixture may also be available via a barcode, a user interface such as a USB interface, an RFID tag or the like.

Once having identified the LED fixture, e.g. by brand, type or technical data, the configuration data may be retrieved/obtained from a database. This can be established in various ways; The data may e.g. be retrieved from the database by a user, e.g. by a manual selection of a corresponding data entry. Also, data may be retrieved from the database by the user entering a type code or other identification data of the LED fixture (e.g. an identification as described above). Still further, data may be retrieved from the database by the LED driver sending a 'LED fixture type code' or other identification to the database, the database (or a server in which the database is comprised) retrieving the configuration data and sending the configuration data directly to the LED driver or to the user for entry in the LED driver.

In an embodiment, the identification data can be entered in a user interface of the LED driver (such a user interface e.g. comprising a digital display and one or more push-buttons for entering a code, in general, the identification data)

In an embodiment, the step of obtaining configuration data from a database using the identification of the LED fixture can thus comprise:

- sending via a communication network a configuration request to a configuration database, and;
- receiving configuration data from the configuration database;

In accordance with the present invention, an LED driver is, in general, applied for powering an LED fixture. As such, the LED driver can e.g. comprise an LED power supply for providing a supply power (voltage and/or current) to the LED fixture. As an example of such an LED power supply, a Buck or Boost converter or other types of converter for providing a current to the LED fixture can be mentioned. In general, an LED driver may also comprise a control unit (e.g. a microprocessor) arranged to control the LED power supply and/or control the LED fixture. As an example, such a control unit may also be applied to control certain aspects of an LED assembly (an LED assembly in general comprising an LED fixture and an LED driver), such as the duty cycle of the LEDs of the LED assembly, thus controlling either or both the brightness and color of the light as produced by the LED assembly. The method of configuring an LED driver according to an aspect of the invention may thus be applied to e.g. configure an LED power supply of the LED driver or a control unit of the LED driver.

In an embodiment, an LED driver may also comprise a control unit and a plurality of LED power supplies, each LED power supply able to power an LED fixture. In such an LED driver, the control unit can be considered to be a centralized control unit controlling the various power supplies and/or the various LED fixtures. In such an embodiment, the configuration of the LED driver can be realized by providing the configuration data to the centralized control unit. Based on the configuration data, the centralized control unit can determine appropriate control signals for controlling the LED fixtures and/or the power supplies of the LED driver.

Within the meaning of the present invention, an LED fixture (or LED unit) is used to denote one or more LEDs. As such, an LED fixture can consist of a single LED or can comprise several LEDs connected in series an/or in parallel. An LED fixture may also comprise several groups of LEDs.

The configuration data may e.g. comprise configuration settings of the LED driver. Additionally, the configuration data may comprise installation information, such as wiring connection data, etc. In order to avoid damage to the lighting installation comprising the LED fixture and LED driver, providing wiring connection data can be an important tool as different LED fixtures may need to be wired differently. Once such wiring connection data is received, an LED driver may automatically determine the appropriate correspondence between an output terminal providing an output signal and an input terminal of the LED fixture.

In an embodiment, the configuration data comprises information regarding the maximum dissipation of the LED fixture. It is worth noting that the allowable or preferred way of operating an LED fixture (which can e.g. be described by the configuration data) may depend on the way the LED fixture is manufactured or assembled or may depend on environmental conditions applicable. The identification of the LED fixture may, as an example, include information regarding the type of housing that is applied. As such, the appropriate configuration data (as obtained from the database) may be the result of a combination of identifiers, e.g. an identification of the LEDs as applied and an identification of the housing as applied.

In an embodiment, the configuration data as obtained form the identification of the LED fixture also relates to controlling cooling means of an LED fixture. LED fixtures having a comparative large power output are often provided with an active cooling device such as a fan or liquid cooler. Such cooling devices can also be powered form the same LED driver that powers the LEDs of the LED fixture but may have different power characteristics or requirements compared to the LEDs. To illustrate this, a first LED fixture may e.g. comprise four LEDs (e.g. having colours Red, Green, Blue and White) which are controlled by an LED driver having one or more power converters such as Buck or Boost converters based on the configuration data received. A second, different LED fixture can e.g. comprise three LEDs (e.g. Red, Green and Blue) and a fan for cooling the LEDs. Based on the identification code, configuration data can be obtained from a database to enable the LED driver receiving the data to both control the LEDs of the LED fixture and the fan for cooling the LEDs.

In order to e.g. automatically identify the LED fixture, identifying the LED fixture may comprise detecting, by the LED driver, a supply of an electrical signal obtained via the LED fixture, and deriving, by the LED driver, an LED fixture identification code from the obtained electrical signal. The electrical signal may a.o. comprise a value of a current through a reference resistor, a signal provided by a bus, such as a field bus, I2C bus, I2S bus, a digital identification code provided by an identification chip, an RFID, etc.

In an embodiment, the LED fixture identification code thus derived is applied in a configuration request which is provided to a database, thereby enabling to automatically retrieve the corresponding configuration data from the database. Identifying the LED fixture by the LED driver may also be realized by a supply of an optical or mechanical or other signal obtained via the LED fixture The method may further comprise identifying the LED driver. As such, the configuration data as obtained from the configuration database can be based on both the LED fixture identification and the LED driver identification. Thereby, the configuration code may be adapted to the type of LED driver, so that different types of LED driver (possibly having different configuration setting requirements), may be coped with. In an embodiment, the configuration request as sent to the configuration database may thus comprise an identification of the LED driver as well as an identification of the LED fixture.

In an embodiment of the method, configuring the LED driver comprises: decoding by a Lookup table the configuration data into LED driver settings, and configuring the LED driver according to the LED driver settings. Thereby, the configuration data may be held as a compact, short identification, which is then converted into the required settings information by looking up the corresponding entry in the data table. The data table may e.g. by an electronic data table, which may e.g. be stored in the LED driver, in an Lighting controller connected to the LED driver, in a programmer which may be connected to the LED driver for configuring the LED driver, etc.

In an embodiment, the configuration data may comprise a meta code, and configuring the LED driver may comprise: decoding the meta code into LED driver specific configuration data; and configuring the LED driver according to the LED driver specific configuration data. The meta code may be understood as a coding of LED driver parameters which is independent of the type of driver. As an example, assume that a plurality of different power supplies are available on the market, and that the application would require the power supplies to provide a current of 0.3 Amperes. Each of the power supplies could require a different coding of the configuration data to configure the driver in question so as to achieve that setting. The meta code could now define a universal code to specify configuration data for different types of LED power supplies. The meta code could for example provide for a specification of current, color assignment, . . . to different output pins, etc. Through the meta code, a variety of types of LED power supplies may be supported, the universal settings of the meta code being translated into settings of the LED driver in question. The decoding of the meta code may take place by any suitable decoding means, such as an Look up table, a decoding algorithm, etc.

In an embodiment, the method may further comprise providing a feedback signal from the LED fixture to the LED driver, and reconfiguring the LED driver according to the feedback signal. Thereby, an iterative configuration method may be provided. The feedback signal may comprise any suitable feedback signal, such as for example a temperature signal provided by a temperature sensor, an LED forward voltage signal, an illumination signal provided by e.g. an illumination sensor such as a PIN diode, etc. Other properties are e.g. the number of LED channels, number of serially connected LEDs per channel, number of parallely connected LEDs per channel, operational current per channel, maximum peak current per channel, maximum duty cycle per channel or per fixture, or for the armature (per housing), etc. Thereby, reliability may be improved as adverse working conditions of the LEDs may be recognized, configurability may be improved as fine tuning or part of the configuration may be set iteratively. Furthermore, installation and configuration procedures may be simplified. Such a feedback signal may also be applied to provide status information on the LED fixture or the use of the LED fixture to the LED driver, e.g. to the control unit of the LED driver or to a central control unit, e.g. controlling a plurality of power supplies each arranged to power an LED fixture. Such feedback information may further be communicated (e.g. by the LED driver or central control unit) to a server thus enabling monitoring the status of the LED fixtures or the LED drivers. Such information can e.g. be applied for maintenance purposes, the information could e.g. indicate the number of hours the LED fixture has operated under certain conditions thus enabling to estimate the likelihood of a failure. As such, the information that is fed back can be applied for preventive maintenance or replacement of the LED fixture. As an alternative, or in addition, the feedback information can be useful in compensating for a decreasing brightness vs. LED current characteristic due to aging.

In an embodiment, configuring the LED driver may comprise: determining from the configuration data an LED driver setting comprising one or more of a power limit per LED or LED group, a total power limit for the LED fixture, and an LED fixture total power limit reduction, and setting the LED driver in accordance with the determined configuration data. Thereby, account may be taken of different limitations of an LED, an LED fixture, a packaged LED fixture, etc. For example, a separate LED may have a certain rating in maximum power dissipation. Combining a plurality of such LEDs into an LED fixture may provide a rating which is lower than the added ratings of the separate LEDs of the fixture. Again, when packaging the LED assembly into a housing, the rating thereof may again be lower. A further reduction may take place by the maximum rating of the LED driver. Each of these reductions may be provided by corresponding settings as provided by the configuration data.

The communication network as applied in the method according to the invention can be a wired or wireless communication network, e.g. PLC, DMX, RF, IR etc, . . . .

According to a second aspect of the invention, there is provided a control unit for an LED driver of an LED assembly, wherein the control unit comprises an input terminal for receiving an input signal, an output terminal for providing a control signal to the LED assembly for controlling the LED assembly, and wherein the control unit is further arranged to:

receive, by means of a download, a program comprising an algorithm for converting the input signal to the control signal for the LED assembly and following receipt of the program, establish a conversion from the input signal to the control signal using the algorithm.

In the control unit according to the invention, the conversion of an input signal (e.g. a DMX signal having a value between 0 and 255, or an RF signal) to a control signal (e.g. to control a current provided to an LED (or LED fixture) of the LED assembly) is realised by applying an algorithm which is provided to the control unit by downloading a program to the control unit.

The control unit according to the invention can e.g. comprise a controller such as a microcontroller or the like. The control unit can e.g. comprise a memory unit for storing the program.

In an embodiment, the algorithm as provided to the control unit by downloading a program enables the control unit to generate a value for the control signal from a value of the input signal based on one or more parameters of the LED assembly or its environment.

By determining the relationship between the control signal and the input signal based on an algorithm, the algorithm e.g. applying one or more parameters of the LED assembly or the environment, the behaviour of an LED assembly controlled by a control unit according to the invention can be adjusted easily to varying user requirements or changes to the LED assembly. By downloading the program/algorithm, the control unit can host a wealth of functionality despite limited resources. Limited resources enable miniaturization and or high efficiency. Therefore downloading can be used to further miniaturize or increase efficiency while still having the same degree of applicability of the control unit and thus LED driver over all possible applications.

It should be noted that, within the meaning of the present invention, the application of an algorithm to enable a conversion from an input signal to a control signal should not be confused with the mere conversion of an input signal to an output signal by a scaling (either a linear or non-linear scaling).

A further advantage provided by the control unit according to the invention is that it facilitates the conversion of a comparatively simple input signal (e.g. a single channel input signal) to a more complex output signal and thus a more complex behaviour of the LED assembly. As an example, a single channel input signal (e.g. a DMX signal ranging from 0-255) can result in a multichannel control signal controlling both an intensity and colour of the LED assembly. As an example, the algorithm can convert the input signal to a plurality of control signals for controlling an intensity of a plurality of LEDs having a different colour thereby resulting in the light output of the LED assembly to follow a particular trajectory in the Cx,y space of the chromaticity diagram when the input signal varies from a first value (e.g. zero) to a second value (e.g. a maximum value). The application of an algorithm for determining the relationship between an input signal and a control signal and which can be provided to the control unit by downloading a program thus significantly increases the functionality of the control unit. In an embodiment, the algorithm as applied to establish a control signal for the LED assembly can apply, apart from parameters of e.g. the LED assembly or the environment, one or more feedback signals of the LED assembly to establish the control signal. Such feedback signals can e.g. be obtained from sensors applied in the LED assemble (e.g. temperature or brightness sensors) or can comprise feedback obtained from the LED assembly circuitry, e.g. providing feedback on the voltage over an LED or LED fixture, a current provided by the power converter, etc. In an embodiment, any parameter of the LED assembly or environment as applied in the algorithm can be provided to the control unit by downloading the parameters together with the program providing the algorithm to the control unit. By doing so, the control unit applying the algorithm can easily be adapted to changes made to the LED assembly. Such changes can e.g. include changes to an LED, or LEDs or LED fixture of the LED assembly, or changes to a power converter of the LED assembly or other. As an example, a change in a thermal resistance of the LED assembly to the environment can affect the operation of the LED assembly and can be adjusted by downloading the modified parameter to the control unit. When the control unit is provided with an algorithm using this parameter, the operation of the LED assembly can automatically adjust to the modified parameter.

The parameters as can be applied in the algorithm to determine a value for the control signal given an input signal can e.g. relate to properties of the LED or LEDs as applied in the LED assembly. As an example, the parameters may describe a brightness characteristic of the LED or LEDs applied. The parameters applied can also describe parasitic features of the LED assembly such as aging of components. The parameters may e.g. also relate to a power converter of the LED assembly (e.g. a Buck or Boost converter) or any other component of the LED assembly. The parameters as applied can e.g. be formulated as a model describing a certain behaviour (e.g. thermal behaviour or aging) of the LED assembly.

In an embodiment, the parameters as applied by the algorithm comprise configuration data for configuring an LED driver of the LED assembly. The parameters or configuration data can be provided to the LED driver by applying the configuration method according to the invention.

In accordance with the present invention, LED assembly is used to denote an LED based lighting application comprising at least one LED for providing an illumination and a power converter for providing a supply power (e.g. a DC current or pulsed current) such as a Buck or Boost converter. The one or more LEDs of the LED assembly (also referred to as an LED fixture) can be arranged in various ways. As an example, an LED fixture can comprise two or more LED groups (each group comprising at least one LED), the LED groups being connected in series. In order to control a current being provided to an LED group or not, each LED group can be provided with a switch in parallel to it (e.g. a FET or MOSFET).

In general, the control signal as obtained from the input signal (by applying the algorithm provided to the control unit) is used to control an illumination parameter (e.g. an intensity or colour) of the LED fixture of the LED assembly.

Therefore, in an embodiment of the present invention, the parameters as can be applied in the algorithm may represent an illumination characteristic or feature of the LED assembly.

Within the meaning of the present invention, a parameter is not only understood as a certain value representing a certain property or feature of the LED assembly, a parameter may also be a function (e.g. described by a table or formula) describing a certain feature or characteristic of the LED assembly.

Within the meaning of the present invention, the parameters as can be applied in the algorithm are however not limited to illumination characteristics or values of the LED assembly. As an example, the parameters as applied in the algorithm may e.g. relate to thermal properties or characteristics of the LED assembly such as a maximum dissipation (either per LED or LED group or in total). To illustrate this, the allowable dissipation of an LED can e.g. be 5 W whereas the total dissipation allowable for a fixture comprising 3 such LEDs may only be 12 W. As such, depending on the required illumination, the dissipation of a single LED or the dissipation of the LED fixture in total can be a limiting factor. Based on the required illumination and the different power limitations, the control unit can determine an appropriate control for the LED fixture and/or the power converter of the LED driver to obtain the require illumination or approximate the required illumination as close as possible.

In an embodiment, the algorithm to be applied by the control unit is provided by downloading a program (e.g. in a memory unit of the control unit) containing the algorithm.

The program may already be compiled and thus readily applicable by the control unit or may be compiled or interpreted by the control unit.

In an embodiment, the algorithm can comprises a model such as a thermal or electric model describing a certain characteristic or behaviour of the LED assembly. Such a model can e.g. describe aspects of the thermal behaviour of the LED assembly (e.g. brightness vs. temperature), or the aging of components, or power limitations of the LED assembly, or other features. The model describing certain aspects of the LED assembly can e.g. be downloaded as part of the algorithm or together with the algorithm applied by the control unit to establish a conversion from the input signal to the output signal. As an alternative, the model or parameters describing the model can be obtained by the control unit in a learning manner. As an example of such determination by learning, a model describing a brightness characteristic of the LED assembly (e.g. brightness vs. current or brightness vs. temperature) can be obtained by operating the LED assembly in a certain manner (e.g. providing a certain current or current characteristic to the LED or LEDs of the assembly), determining the response of the LED assembly and providing the response or a signal representative of the response to the control unit. Often, an LED assembly comprises one or more sensors for monitoring a characteristic of the LED assembly (e.g. a brightness or a temperature). Such a sensor can e.g. be applied to determine the response of the LED assembly and thus facilitate in the characterisation of the model or model parameters. As an alternative, an external sensor (e.g. combined with a transmitter) can be applied to determine the response of the LED assembly to a certain current set point and providing the response or a signal representative of the response to the control unit. So, according to an embodiment of the invention, parameters as applied in the algorithm are not downloaded or incorporated in the algorithm but are obtained from measurements or obtained by a readout of a memory unit of the LED assembly (e.g. provided in a control unit of the LED driver of the LED assembly). In order to control the LED assembly by the control unit prior to the download of the program comprising the algorithm, the control unit can be provided with a default input to output conversion for determining the control signal from the input signal.

According to an aspect of the invention, there is provided an LED assembly comprising:

an LED fixture comprising at least one LED, an LED driver comprising a power converter for providing a supply power to the LED fixture, and a control unit according to the invention wherein the plurality of parameters comprises at least one parameter of the LED fixture and at least one parameter of the power converter. Such parameters can e.g. describe thermal limitations or characteristics of the LED fixture resp. the power converter.

According to a further aspect of the invention there is provided a method of controlling an LED assembly, the LED assembly comprising:

an LED fixture comprising at least one LED, an LED driver comprising a power converter for providing a supply power to the LED fixture, and a control unit for controlling the power converter and/or the LED fixture, the method comprising the steps of:

receiving an algorithm for determining a control signal value from an input signal value by downloading a program to the control unit, receiving an input signal by the control unit, converting an input signal value of the input signal to a control signal value using the algorithm, controlling the power converter and/or LED fixture of the LED assembly using the control signal value.

In an embodiment of the method of controlling an LED assembly, the LED driver of the LED assembly is configured according to the configuration method according to the invention. In such an embodiment, both the configuration data for configuring the LED driver as the way this data is used in an algorithm for converting an input signal to a control signal can be provided in a flexible manner allowing a user or person installing the LED assembly to easily adjust the behaviour of the LED assembly.

Further features and advantages of the invention will become clear form the appended drawings and below description, in which different non limiting embodiments of the invention are disclosed.

DETAILED DESCRIPTION OF THE INVENTION

Figure 1A:
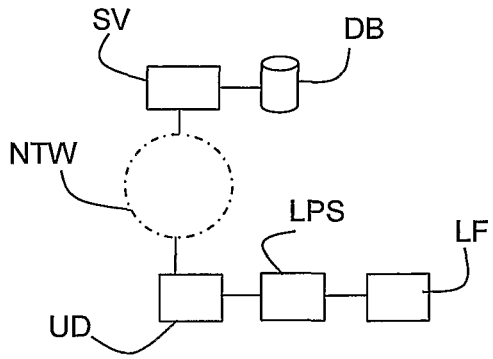
FIG. 1*a* highly schematically depicts a configuration download setup according to an embodiment of the invention.

FIG. 1*a* depicts a database DB comprising configuration data. The data base is via a server SV (such as a web server or other network server) connected to a communication network NTW, such as the internet, a telecommunication network, a DMX communication bus, etc. The network is connected to a user communication device UD, such as a personal computer, notebook, (e.g. internet enabled) mobile telephone, etc to which an LED driver LPS may be connected. The LED driver is connected to an LED fixture LF to drive it. It is noted that the driving of the LED fixture may comprise providing electrical power to it and/or driving different groups of the LEDs of the LED fixture (e.g. different colors) according to e.g. a users needs. In order to configure the LED driver, the LED driver and/or the LED fixture are to be identified. This may take place in a variety of ways. An identification may for example be sent by the LED driver to the user device UD (either autonomously by the LED driver or upon receipt of a request message sent to the Led driver by the user device UD), the user device may identify the LED driver and/or the LED fixture from a type number, manufacturer code, etc. The LED driver may further receive an identification signal form the LED fixture, the identification signal e.g. comprising an LED fixture identification. Many other identifications are possible: the LED driver and/or the LED fixture may for example be provided with a barcode, the LED fixture and/or LED driver may for example initiate a transmission of an Light pulse sequence (by an appropriate driving of the LEDs of the Led fixture) which pulse sequence enables identification of the Led fixture and/or the LED driver, etc. The device receiving the high pulse sequence may be the LPS or the UD while interpretation can also be done by the LPS or UD or by the SV or DB by communicating the pulse sequence to them.

Also, identification may be performed by reading a type code, type number or similar of the LED driver and/or LED fixture. Once having been identified, a request for configuration data is sent from the user device UD via the network NTW to the server SV. The request may comprise a request message comprising an identification of the LED driver and/or the LED fixture. Also, the request may be provided by a user of the user device receiving via the network a selection list, such as an internet page listing, an internet page table, internet page selection menu, etc, which allows the user of the user device to select the corresponding LED driver type and/or LED fixture type in a table. The server, having access to the database DB, looks up the corresponding configuration data and forwards it to the user device. The configuration data may in this example be loaded into the driver which is connected to it, or may be entered by the user by any suitable means: via a wireless connection, by entering the code on a keypad (not shown) connected to the LED driver, via a DMX bus or I2C bus to which the LED driver may be connected, etc. Also, the data may be entered by setting switches, such as DIP switches, a rotary switch, etc. The configuration data may further comprise a wiring scheme to enable the user to connect the (various channels, e.g. colors of the) LED fixture to the Led driver outputs.

Figure 1B:
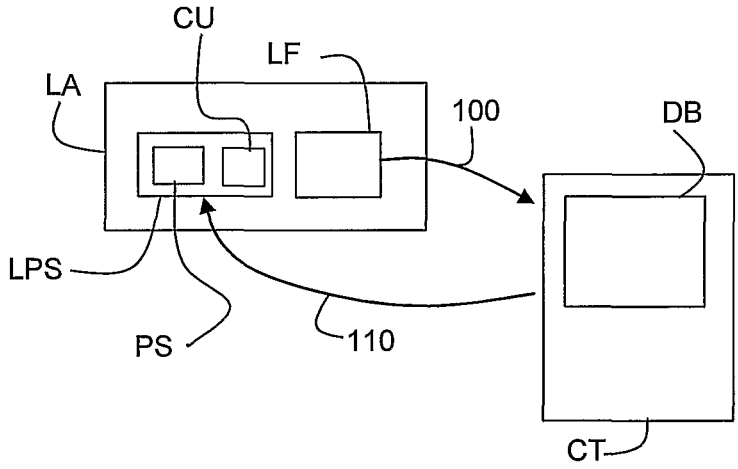
FIGS. 1*b*-1*c* schematically indicate embodiments of the configuration method according to the invention.
Figure 1C:
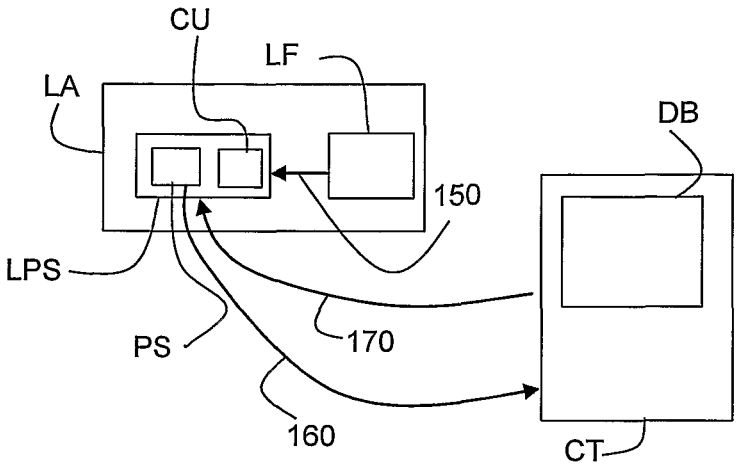

FIGS. 1*b*-1*c* schematically depict some further embodiments of a configuration setup according to the invention. FIG. 1*b* schematically depicts an LED assembly LA comprising an LED driver LPS and an LED fixture LF that is to be driven by the LED driver LPS. FIG. 1*b* further shows a configuration database DB which can e.g. be part of a (mobile) configuration tool CT whereby the tool is configured to receive an input signal (comprising identification data of the LED fixture) and is configured to provide an output signal (comprising configuration data for the LED driver).

In order to configure the LED driver using the components as described, any of the following embodiments can be implemented.

In a first embodiment as shown in FIG. 1*b*, the identity of the LED fixture LF is made available directly to the CT or the database DB of the configuration tool CT, indicated by arrow 100. The configuration tool can e.g. be equipped with a barcode reader or an RFID reader to receive an input signal enabling the identification of the LED fixture. Upon receipt of the identification data, configuration data can be retrieved from the database DB, based on the identification and an output signal comprising the configuration data can be provided to the LED driver LPS, indicated by arrow 110. This can be realized by either a wired interface (e.g. using PLC or DMX, . . . ) or a wireless interface (RF, IR, . . . ). The configuration data may thus be received by a control unit CU of the LED driver. The configuration data may, in an embodiment be readily applicable by the control unit to control a power supply PS of the LED driver LPS and/or the LED fixture. Alternatively, the configuration data can be in a format referred to as meta-code (as explained above) which can be interpreted by the LED driver and converted to appropriate settings and operating parameters for controlling/powering the LED fixture.

FIG. 1*c* schematically depicts an other embodiment indicating the same components as shown in FIG. 1*b*. In order to configure the LED driver LPS, the identification of the LED fixture LF is made available to the LED driver LPS (indicated by arrow 150). This can be realized by any form of communication means, e.g. near field communication, RF, IR or wired communication. Subsequently, the information regarding the identity of the LED fixture is provided, by the LED driver, optionally together with information enabling an identification of the LED driver, to the database DB or configuration tool CT, indicated by arrow 160, whereupon the configuration data as retrieved from the database DB can be provided to the LED driver LPS, as indicated by arrow 170.

In case the information enabling the identification of the LED fixture is provided to the LED driver, the information carrier (e.g. an RFID tag or the like, a reference resistor, . . . ) provided with the information can either be temporarily brought in contact with the driver (thereby providing the required information to the driver), or can be stored on a more permanent basis in the driver, e.g. on board the LED driver.

In an embodiment, an LED assembly can comprise a plurality of LED fixtures LF, each provided with a power supply PS, the LED assembly further comprising a single control unit CU for controlling the plurality of power supplies and or the LED fixtures. In such an embodiment, the control unit CU can also be referred to as a central control unit. In an embodiment, such a central control unit can be provided with information on the LED fixtures (i.e. identifying the LED fixtures, e.g. by any of the communication means as discussed above, whereupon the central control unit can retrieve the appropriate configuration data from a database. In an embodiment, said database can be integrated in the central control unit. Alternatively, the database can be accessible via a communication network as indicated above. As in de arrangement as described in FIG. 1*b*, the central control unit can be provided with information identifying the plurality of the power supplies. As such, the configuration data for the LED drivers may also depend on the type of LED driver in combination with the type of LED fixture.

The invention as disclosed may be applied with any type of LED driver, e.g. a pulse width modulation driver, parallel current source driver having a current source for each one of the LED channels (groups), a current source driver in which the groups of LEDs are connected in series, while parallel switches are provided to short circuit an LED or LED group in order to switch it off, etc.

The configuration data may be provided in many forms. As an example, the configuration data may comprise a code, such as a numeric identification code, which can be provided to the LED driver in one of the ways as described above. The code may be translated into configuration settings for the LED driver in a plurality of ways. For example, a Look up table may be provided, e.g. in the user device UD or in the LED driver, to provide the configuration data from the code. In another example, a decoding algorithm may be applied to decode the code. Examples of such decoding algorithms will be described with reference to the below table.

TABLE 1

| LEDCODE XXXX/XXX | | | | |
|---|---|---|---|---|
| Current setting CS1 | | | | |
| DIGIT3 | 0 | auto sensing | | |
| | 1 | 350 mA | | |
| | 2 | 500 mA | | |
| | 3 | 700 mA | | |
| | 4 | 900 mA | | |
| | 5 | 1050 mA | | |
| | 6 | 1200 mA | | |
| | 7 | 1400 mA | | |
| | 8 | 1500 mA | | |
| | 9 | 2000 mA | | |
| Network channels | | | | |
| DIGIT4 | 1 | 1N1L | | 1 network ch/1 ledgroup connected |
| | 2 | 2N2L | | 2 network ch/2 ledgroups connected |
| | 3 | 3N3L | | 3 network ch/3 ledgroups connected |
| | 4 | 4N4L | RGBW | 4 network ch/4 ledgroups connected |
| | 5 | 4N4L | RGBA | 4 network ch/4 ledgroups connected |
| | 6 | 1N4L | | 1 network ch/4 ledgroups connected |
| | 7 | 2N4L | | 2 network ch/4 ledgroups connected |
| | 8 | 3N4L | RRGB | 3 network ch/4 ledgroups connected |
| | 9 | 3N4L | RGGB | 3 network ch/4 ledgroups connected |
| Duty cyle setting | | | | |
| DIGIT1&2 BIT1&2 | XX | No Duty cycle | | |
| | XO | 1, 3 Duty cycle | | |
| | OX | 1, 5 Duty Cycle | | |
| | OO | Not used yet | | |
| NTC setting | | | | |
| BIT3&4 | XX | NTC Profile 1 (standard) | | |
| | XO | NTC Profile 2 | | |
| | OX | NTC Profile 3 | | |
| | OO | NTC Profile 4 | | |
| Thermal limit remapping | | | | |
| BIT5&6 | XX | No limitation | | |
| | XO | Thermal limitation desaturated colours reduction 0, 5 channel | | |
| | OX | Thermal limitation desaturated colours reduction 1 channel | | |
| | OO | Thermal limitation desaturated colours reduction 2 channel | | |
| Current setting CS2 | | | | |
| DIGIT5 | 0 | Same setting as Digit 1 | | |
| | 1 | 350 mA | | |
| | 2 | 500 mA | | |

TABLE 1-continued

| LEDCODE XXXX/XXX | | |
|---|---|---|
| | 3 | 700 mA |
| | 4 | 900 mA |
| | 5 | 1050 mA |
| | 6 | 1200 mA |
| | 7 | 1400 mA |
| | 8 | 1500 mA |
| | 9 | 2000 mA |
| | | Current setting CS3 |
| DIGIT6 | 0 | Same setting as Digit 1 |
| | 1 | 350 mA |
| | 2 | 500 mA |
| | 3 | 700 mA |
| | 4 | 900 mA |
| | 5 | 1050 mA |
| | 6 | 1200 mA |
| | 7 | 1400 mA |
| | 8 | 1500 mA |
| | 9 | 2000 mA |
| | | Current setting CS4 |
| DIGIT7 | 0 | Same setting as Digit 1 |
| | 1 | 350 mA |
| | 2 | 500 mA |
| | 3 | 700 mA |
| | 4 | 900 mA |
| | 5 | 1050 mA |
| | 6 | 1200 mA |
| | 7 | 1400 mA |
| | 8 | 1500 mA |
| | 9 | 2000 mA |

Table 1 provides an example of a configuration code, in this example referred to as LED code, comprising a group of 4 digits and an optional group of 3 digits (XXXX/XXX). Each digit may e.g. have a value between 0 and 9, when applying a decimal system or between 0 and F when applying a hexadecimal system, thereby, each digit may provide 10 respectively 16 different values. As an alternative, each digit may e.g. have a value between A and Z or A and 9 thus providing 26 or 36 values respectively. Further values can e.g. be included using the greek or other alphabet. As depicted in table 1, digits 3, 5, 6 and 7 provide for current settings of different channels of the LED driver (the channels may each drive a different group of LEDs of the LED fixture), A plurality of current settings are provided as examples. In addition, a setting may be provided for activation of an autosensing algorithm, whereby the LED driver is arranged to autonomously (e.g. iteratively or by means of a negative feedback system) provide an adequate current setting (e.g. by means of measuring an LED temperature, an LED light output, etc). Digit 4 provides for a combination of networking settings (i.e. network connected to the LED driver or not) and channel configuration in order to express how many of the channels of the LED driver are required to be active, and which color groups (e.g. Red Green Blue and White or Red Green Blue and Amber, or Red, Green and blue, etc are provided. Decimal or Hexadecimal or other types of digits 1 and 2 are in this example decoded into binary data, the bits of the binary data being applied to e.g. indicate duty cycle settings, Negative Temperature Coefficient settings and thermal limit settings.

The data as depicted above may be directly loaded into the LED driver, or may act as a "meta code", i.e. a driver type/manufacturer independent configuration data set which is converted e.g. by the LED driver or the User Device into corresponding LED driver settings.

In another example, the configuration data may comprise an identification number, such as a code similar to the Personal Identification Code (PIN code) which is applied in banking identification. Such code may then provide the configuration data by means of e.g. an Look up table.

The following tables provide alternative configuration codes as can be applied in the method of configuring an LED driver according to an aspect of the invention.

TABLE 2

| 1 | | | | (1 bit) | Ledcode | | |
|---|---|---|---|---|---|---|---|
| x | | | | | Led code<br>Direct code | | |
| 1 | 2 | 3 | 4 | (4 bit) | Network channels | | |
| | | | | 1 | 1N1L | | 1 network ch/1 ledgroup connected |
| x | | | | 2 | 2N2L | | 2 network ch/2 ledgroups connected |
| | x | | | 3 | 3N3L | | 3 network ch/3 ledgroups connected |
| x | x | | | 4 | 4N4L | RGBW | 4 network ch/4 ledgroups connected |
| | | x | | 5 | 4N4L | RGBA | 4 network ch/4 ledgroups connected |
| x | | x | | 6 | 1N4L | | 1 network ch/4 ledgroups connected |
| | x | x | | 7 | 2N4L | | 2 network ch/4 ledgroups connected |

TABLE 2-continued

| | | | | | | | | |
|---|---|---|---|---|---|---|---|---|
| x | x | x | | | 8 | 3N4L | RRGB | 3 network ch/4 ledgroups connected |
| | | | x | | 9 | 3N4L | RGGB | 3 network ch/4 ledgroups connected |
| x | | | x | | 10 | not used | (more channel options??) | |
| | x | | x | | 11 | not used | (more channel options??) | |
| x | x | | x | | 12 | not used | (more channel options??) | |
| | | x | x | | 13 | not used | (more channel options??) | |
| x | | x | x | | 14 | not used | (more channel options??) | |
| | x | x | x | | 15 | not used | (more channel options??) | |
| x | x | x | x | | 16 | Extended code | | |
| 1 | 2 | | | | (2 bit) | Thermal limit remapping | | |
| | | | | | 1 | No limitation | | |
| x | | | | | 2 | Termal limitation desaturated colors reduction 0, 5 channel | | |
| | x | | | | 3 | Termal limitation desaturated colors reduction 1 channel | | |
| x | x | | | | 4 | Termal limitation desaturated colors reduction 2 channel | | |
| 1 | 2 | | | | (2 bit) | NTC setting | | |
| | | | | | 1 | 50 deg. celsius | | |
| x | | | | | 2 | 60 deg. celsius | | |
| | x | | | | 3 | 70 deg. celsius | | |
| x | x | | | | 4 | 80 deg. celsius | | |
| 1 | 2 | | | | (2 bit) | Duty cyle setting (eco) | | |
| | | | | | 1 | No duty cycle | | |
| x | | | | | 2 | 1, 3 Duty cycle | | |
| | x | | | | 3 | 1, 5 Duty cycle | | |
| x | x | | | | 4 | not used | | |
| 1 | 2 | 3 | | | (3 bit) | Current setting 2/3/4 (power) | | |
| | | | | | 1 | all standard | | |
| x | | | | | 2 | 2 different, 3/4 standard | | |
| | x | | | | 3 | 2/4 standard, 3 different | | |
| x | x | | | | 4 | 2/3 different, 4 standard | | |
| | | x | | | 5 | 2/3 standard, 4 different | | |
| x | | x | | | 6 | 2/4 different, 3 standard | | |
| | x | x | | | 7 | 2 standard, 3/4 different | | |
| x | x | x | | | 8 | all different | | |
| 1 | 2 | 3 | 4 | 5 | (5 bit) | Current Setting | | |
| | | | | | 1 | 200 mA | | |
| x | | | | | 2 | 250 mA | | |
| | x | | | | 3 | 300 mA | | |
| x | x | | | | 4 | 350 mA | | |
| | | x | | | 5 | 400 mA | | |
| x | | x | | | 6 | 450 mA | | |
| | x | x | | | 7 | 500 mA | | |
| x | x | x | | | 8 | 550 mA | | |
| | | | x | | 9 | 600 mA | | |
| x | | | x | | 10 | 650 mA | | |
| | x | | x | | 11 | 700 mA | | |
| x | x | | x | | 12 | 750 mA | | |
| | | x | x | | 13 | 800 mA | | |
| x | | x | x | | 14 | 850 mA | | |
| | x | x | x | | 15 | 900 mA | | |
| x | x | x | x | | 16 | 950 mA | | |
| | | | | x | 17 | 1000 mA | | |
| x | | | | x | 18 | 1050 mA | | |
| | x | | | x | 19 | 1100 mA | | |
| x | x | | | x | 20 | 1150 mA | | |
| | | x | | x | 21 | 1200 mA | | |
| x | | x | | x | 22 | 1250 mA | | |
| | x | x | | x | 23 | 1300 mA | | |
| x | x | x | | x | 24 | 1350 mA | | |
| | | | x | x | 25 | 1400 mA | | |
| x | | | x | x | 26 | 1500 mA | | |
| | x | | x | x | 27 | Not used | 1750 mA | |
| x | x | | x | x | 28 | Not used | 2000 mA | |
| | | x | x | x | 29 | Not used | 2250 mA | |
| x | | x | x | x | 30 | Not used | 2500 mA | |
| | x | x | x | x | 31 | Autosens | | |
| x | x | x | x | x | 32 | Extended code | | |

TABLE 3

| | | | | | | | |
|---|---|---|---|---|---|---|---|
| 1 | | | | | (1 bit) | Ledcode | |
| | | | | | | Ledcode | |
| x | | | | | | Direct code | |
| 1 | 2 | | | | (4 bit) | Mode | |
| | | | | | 1 | Color | |
| x | | | | | 2 | Show | |
| | x | | | | 3 | DMX | |
| x | x | | | | 4 | Dali | |
| 1 | 2 | 3 | | | (3 bit) | Quickset | |
| | | | | | 1 | Speed 0 | Dimm 0 |
| x | | | | | 2 | Speed 0 | Dimm Full |
| | x | | | | 3 | Speed Diff | Dimm 0 |
| x | x | | | | 4 | Speed Diff | Dimm Full |
| | | x | | | 5 | Speed 0 | Dimm Diff |
| x | | x | | | 6 | Speed 0 | Dimm Diff |
| | x | x | | | 7 | Speed Diff | Dimm Diff |
| x | x | x | | | 8 | Speed Diff | Dimm Diff |
| 1 | 2 | | | | (2 bit) | External input | |
| | | | | | | Off | |
| x | | | | | | Show | |
| | | | | | | Speed | |
| x | x | | | | | Dimmer | |
| 1 | 2 | 3 | | | (3 bit) | Show selection | |
| | | | | | | 0 tot 20 | |
| 1 | 2 | 3 | 4 | 5 | (8 bit) | Speed | |
| | | | | | | 99 tot 99 | |
| 1 | 2 | 3 | 4 | 5 | (10 bit) | Dimm 000-999 | |

As can e.g. be seen from Table 3, the configuration code may also include information for configuring various light shows or operating parameters of light shows.

Although the above provides the example of LED driver settings, it is imaginable that the LED fixture is configurable also. A configuration of an LED fixture can e.g. enable a manipulation of the direction or shape of an Light beam of an LED fixture. Equally, it may be possible to control optical characteristics such as opaqueness/diffusing of an Light beam of the LED fixture.

Figure 2:
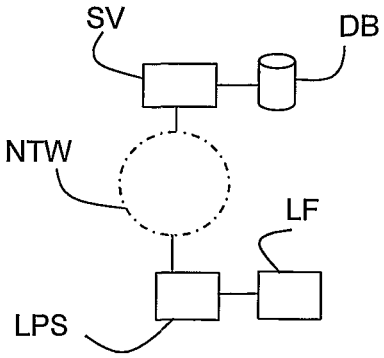
FIG. 2 highly schematically depicts another configuration download setup according to an embodiment of the invention.

FIG. 2 depicts another embodiment, which differs form that depicted in FIGS. 1*a*-1*c* in that the LED driver LPS is directly connected to the network. In this example, an automatic configuration may be provided in that identification data is sent by the LED driver via the network to the Server, the server in response thereto providing configuration data to the LED driver.

In the above examples, the configuration data having been provided to the LED driver, appropriate configuration registers, a configuration data memory, or similar of the LED driver is provided with the required data so as to allow the LED driver to operate in accordance with the configuration data.

It will be understood that in FIGS. 1*a*-1*c* and FIG. 2, any of the networks or connections as shown may comprise any type of connection, (wired, wireless, serial parallel etc.), any type of protocol, etc, any type of network topology, etc.

In an embodiment, the configuration of the LED driver may comprise: a determining from the configuration data a plurality of ratings. Thereby, account may be taken of different limitations (e.g. maximum power ratings) of an LED, an LED fixture, a packaged LED fixture, etc. For example, a separate LED may have a certain rating in maximum power dissipation. Combining a plurality of such LEDs into an LED fixture may provide a rating which is lower than the added ratings of the separate LEDs of the fixture. Again, when packaging the LED fixture into a housing, the rating thereof may again be lower. A further reduction may take place by the maximum rating of the LED driver. Each of these reductions may be provided by corresponding settings as provided by the configuration data.

Further aspects of the present invention relate to a more versatile way to control the behaviour of an LED assembly. In an embodiment of the present invention, this is obtained by providing a control unit for controlling the LED assembly, wherein the control unit is arranged to convert an input signal (e.g. received at an input terminal of the control unit) to a control signal for the LED assembly using an algorithm provided to the control unit by downloading a program comprising the algorithm or enabling the algorithm to be executed. As a result, the relationship between an input signal received at an input terminal and a response of the LED assembly need not be predefined or fixed. According to the invention, the relationship between an input signal received by the control unit and a control signal is determined by an algorithm that is downloaded to the control unit. Such an approach further enables a comparatively simple input signal to be converted to a comparatively complex output signal, e.g. controlling a plurality of LEDs or LED units according to a downloaded algorithm.

Such an approach enables an LED assembly to respond in a manner determined by the algorithm as provided to the control unit.

Figure 3:
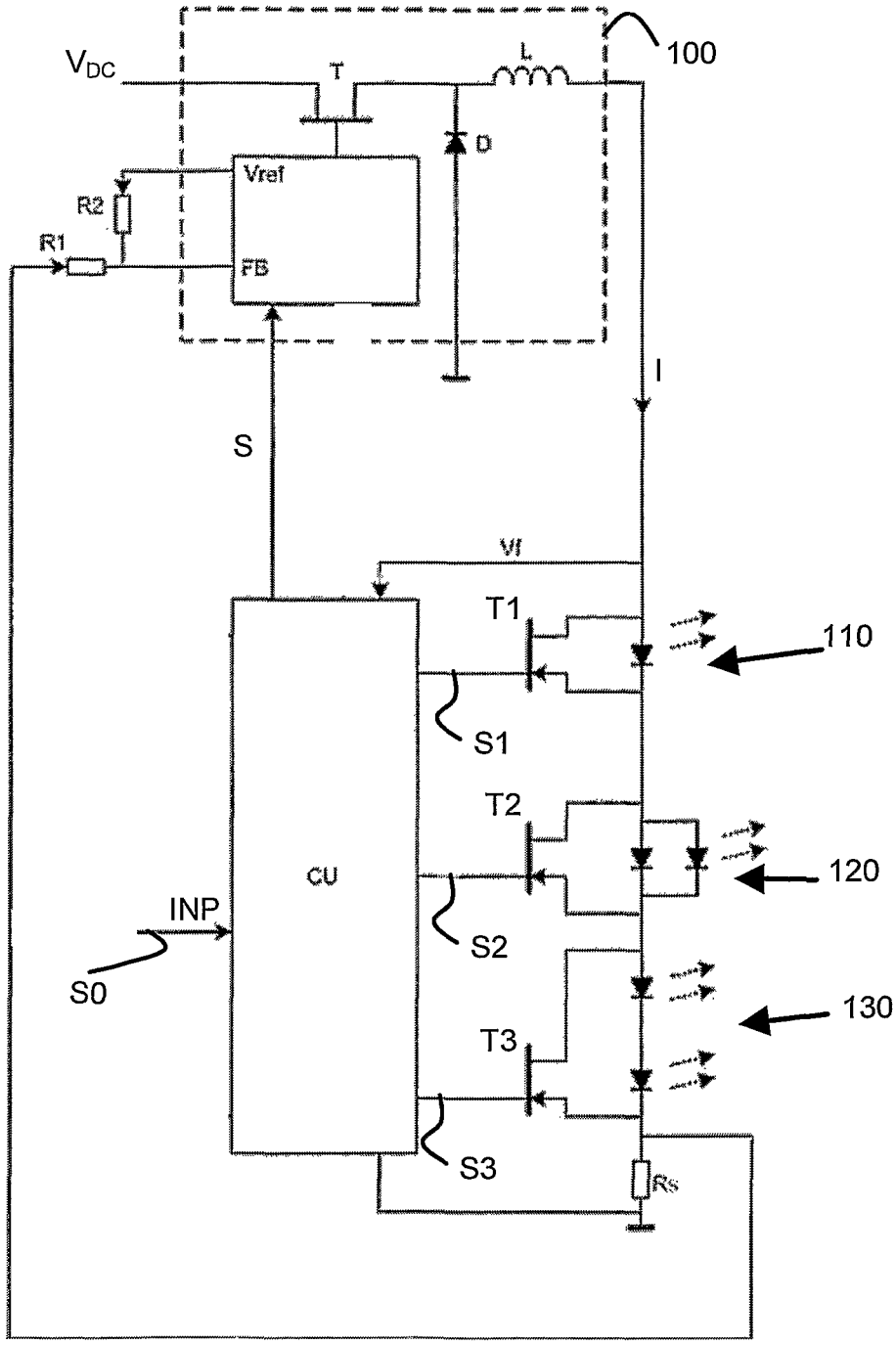
FIG. 3 schematically depicts an LED assembly according to the invention including a control unit according to the invention.

FIG. 3 schematically depicts a control unit CU according to the invention, applied in an LED assembly according to the invention. The LED assembly comprises three LED fixtures 110, 120 and 130 each comprising at least one LED. The LED assembly as shown further comprises a converter 100. The controller CU is arranged to control the converter 100 (indicated by the signal S) and/or the current provided to the LED fixtures. The current through each LED group is controlled by switches T1, T2 and T3 (e.g. MOSFET's) (indicated by the control signals S1, S2, S3) that can short-circuit the resp. LED fixtures 110, 120 and 130 thereby redirecting the current I provided by the converter 100 from the LED fixtures to the resp. MOSFETs. The converter as shown is a so-called Buck converter. In general, the converter used to power an LED fixture is connected to a rectified voltage $V_{DC}$ originating from a mains power supply, e.g. 230 V at 50 Hz via an AC/DC converter (not shown). The control unit CU as shown further comprises an input terminal INP arranged to receive an input signal S0 (e.g. from a user interface). The control unit according to the invention is further arranged to convert the input signal S0 to a control signal for the LED assembly (e.g. signal S, or signals S1, S2, S3) using an algorithm provided to the control unit. In an embodiment of the invention, the algorithm as provided to the control unit CU uses one or more parameters of the LED assembly or the environment for determining the control signal. The algorithm can be provided to the control unit by downloading a program to the control unit. Such a program can e.g. be stored in a memory unit of the control unit and, upon execution, convert a value of the input signal to a value of the control signal according to the algorithm.

In an embodiment, the control unit according to the invention may also comprise a default conversion between an input signal and a control signal. In such a situation, when a program is downloaded, the input-output relationship as described by the algorithm of the program can overrule the default behaviour of the control unit. Such a default conversion may advantageously be applied in case the algorithm used applies a model or parameters describing the LED assembly which are obtained in a learning manner. Such a default conversion can e.g. take the form of a default model having default values for the model parameters.

Figure 4:
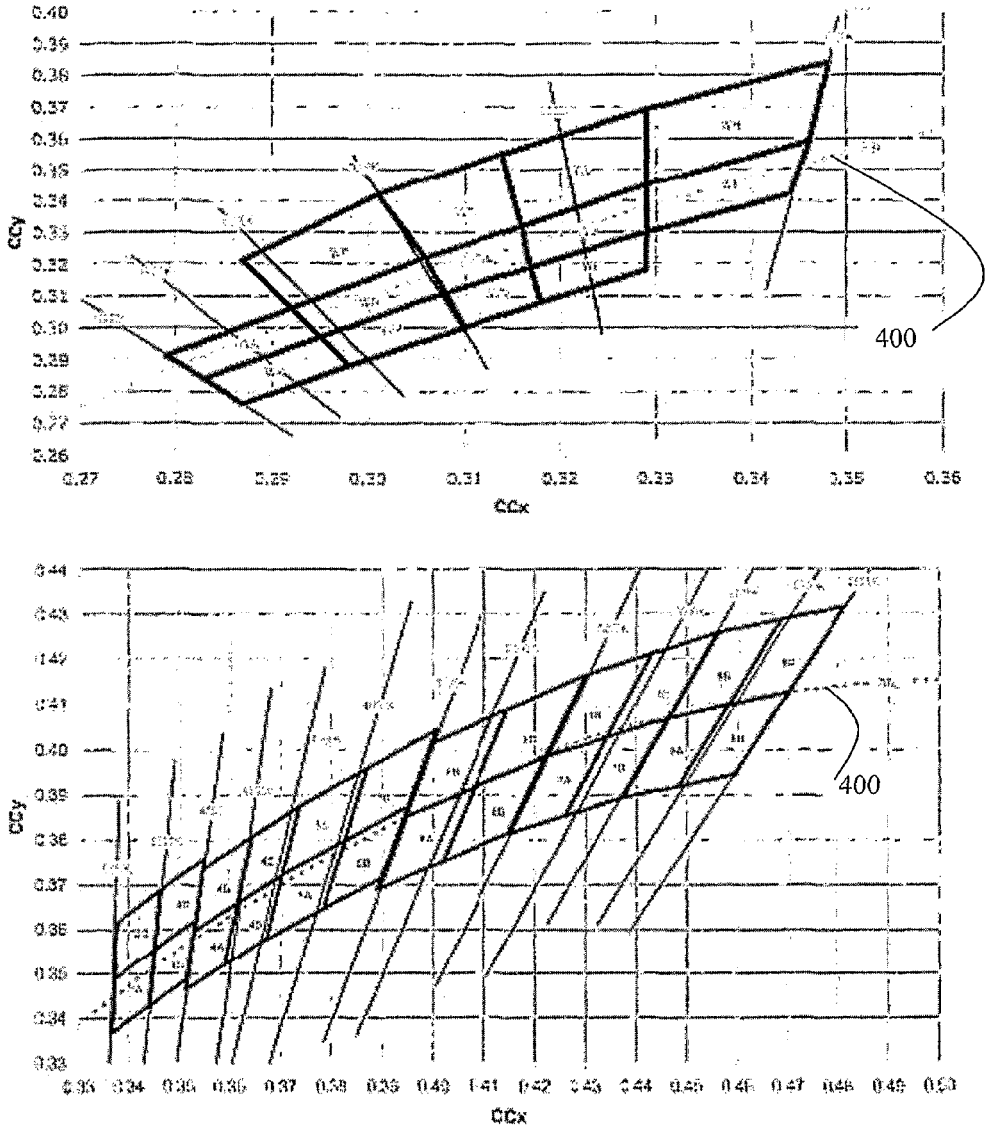
FIG. 4 schematically depicts a CEI diagram.

In an embodiment, the algorithm as provided to the control unit can provide a conversion from an input signal (e.g. a DMX signal having a value varying from 0 to 255) to a control signal controlling an intensity of a plurality of LEDs of the LED assembly thereby following a specific graph of the CEI diagram. Such a graph can e.g. describe that at comparatively low intensity, a certain colour or colour temperature is realised by the plurality of LEDs of the LED assembly while at a comparatively high intensity, a different colour or colour temperature is realised. As such, a single input signal, e.g. originating from a conventional dimmer, can be converted by the control unit, by using the algorithm, into a plurality of control signals for controlling the intensity of the plurality of LEDs of the assembly. As an example, the specific graph that is followed may e.g. correspond to the Plankian curve of the CEI diagram. Such a graph 400 is schematically depicted in FIG. 4, schematically depicting the CEI diagram.

As a further example, the algorithm as provided to the control unit can convert the input signal to a specific colour set point until a maximum intensity of at least one of the LEDs is obtained. A further increase of the input signal may then be converted into a further increase in intensity of one or more of the other LEDs of the fixture until all LEDs operate at maximum intensity when the input signal reaches its maximum value. Following such a graph, a predetermined colour set point is maintained as long as possible (i.e. the ratio between the intensities of the different LEDs of an assembly is preserved until one LED operates at maximum intensity), while at the same time, a user may further increase the intensity, at the expense of a change in colour.

The algorithm as downloaded to the control unit according to the invention may, as explained in more detail below, be applied to ensure proper operation of the LED assembly taking thermal limitations of the LED assembly into account. When a thermal limitation of the LED assembly is reached, the application of a downloaded algorithm can prevent the occurrence of damage to the LED assembly in case a user would request an output characteristic resulting in e.g. too much dissipation in e.g. an LED of the LED assembly or in an LED fixture of the assembly or in a power converter of the assembly.

Readily applying an algorithm that takes into account one or more thermal limitations of the LED assembly may however have an adverse effect on the behaviour of a user interface as perceived by the user. This can be understood as follows: In order to change an intensity of a light source, a user interface such as a dimmer having a rotatable knob or a slider is applied. In general, such a slider or knob has a predetermined displacement range which should, in general, correspond to an intensity range from zero light output to maximum light output. In case the light output is restricted due to the application of an algorithm taking into account a thermal limitation of the LED assembly, the light output of the LED assembly could reach a maximum value before the slider or knob reaches the end of its displacement range. A further displacement of the slider of knob towards the end of the displacements range would then result in the light output remaining substantially constant. Such behaviour could be perceived by the user as a malfunction of the dimmer or the lighting application, i.e. the LED assembly. In order to overcome this, in an embodiment of the present invention, the relationship between an input signal (e.g. obtained or derived from a dimmer knob or slider position) and a corresponding light output is rescaled in order to ensure that substantially the entire displacement range of a dimmer can be used to alter the light intensity. Such a rescaling can be realised in different manners. As an example, a maximum value of the input signal corresponding to a position at the end of the displacement range of a dimmer can be provided together with algorithm to the control unit. This maximum value of the input signal can be matched with the maximum light output level as allowed by the algorithm. As a result, operating the dimmer along its displacement range can thus substantially correspond to the light output ranging from zero to a maximum light output as determined by the algorithm. A similar situation may occur in case a dimmer (or in general a user interface) enables the separate selection of an intensity of different LEDs. As an example, an LED group could consist of a cold white LED and a warm white LED whereby the intensity of each LED can be controlled by a slider. Due to a maximum dissipation of the LED group, it is assumed that the maximum intensity of both LEDs summed is 120% of the maximum intensity of a single LED. As will be understood, when starting with both sliders at 0%, one slider can be moved from 0 to 100% thereby changing the intensity of e.g. the warm white LED from 0% to 100%. A one-to-one relationship between the displacement range of the slider and the intensity range of the LED can thus be maintained. Assuming the warm white LED to operate at 100% intensity, operating a second slider controlling the intensity of the cold white LED would result in a ceiling being reached at 20% of the displacement range of the slider. In order to overcome this, the one-to-one relationship between the displacement range of the slider associated with the warm white LED and the intensity range of the warm white LED can be changed to a one-to-F (F being smaller than 1) relation when the second slider is displaced beyond 20% of its range. As such, a further increase of the intensity of the cold white LED would further effect in a decreased intensity of the warm white LED.

As an alternative, the relationship between the displacement range of the second slider associated with the warm white LED and the intensity range of the warm white LED could be made dependent from the intensity of the cold white LED (or dissipation of the cold white LED) over the entire range. For the given example, in case the cold white LED is at 100% intensity the relationship between the displacement range of the slider associated with the warm white LED and the intensity range of the warm white LED could be made such that when the second slider is moved from 0 to 100% of its range, the intensity of the warm white LED changes from 0 to 20%.

As will be clear from the above, different approaches, which could be implemented by different algorithms, can be applied to ensure that a user interface remains fully effective over its entire operating range, even when the LED assembly light output is limited in some way (e.g. by implementation of an algorithm taken a thermal limitation of the LED assembly into account). As such, the application of such an algorithm in a control unit according to the invention enables to establish a one-to-one relationship between an input signal of the control unit (obtained from the user interface) and the control signal over an entire range of the input signal. As an example, the entire range of the input signal can e.g. consist of values from 0 to 512, the algorithm ensuring that a unique value for the control signal is obtained for each value of the input signal. As a result, over the entire operating range of the user interface, the user will observe a change in behaviour of the LED assembly.

More advanced ways of adapting the conversion from an input signal (corresponding to a dimmer position) to an output characteristic are however also feasible.

As already mentioned above, in an embodiment, the algorithm provided to the control unit can convert an input signal provided to the control unit to a control signal taking into account thermal limitations of both an LED fixture of the LED assembly and a power converter of the LED assembly that is being controlled by the control unit. In general, various operational limitations such as thermal limitations may exist when an LED assembly is operated. The following limitations can be mentioned:

1. Maximum continuous current provided to an LED of the LED assembly.
2. Maximum continuous current as provided by a power convertor of the LED assembly.
3. Maximum continuous dissipation of the LED fixture of the LED assembly.
4. Maximum current provided to an LED regardless of duty cycle. Each of these limitations can be described as a maximum continuous dissipation of either an LED, a power converter or an LED fixture.

As will be appreciated by the skilled person, different operational limitations may occur in an LED assembly. Which of the limitations mentioned is reached first (and thus limits the operation of the LED assembly) may depend on the operating conditions. When only one of a plurality of LEDs is to be operated, limitation 1 as mentioned above is probably reached first. When, on the other hand, all LEDs of the LED assembly are operated (e.g. at the same comparatively high duty cycle), limitation 2 or 3 may be reached first thereby e.g. limiting the current that can be provided to the LEDs to a level that is lower than determined by limitation 1. In order to ensure that no unnecessary limitations are imposed to the operation of an LED assembly, an algorithm can be provided to the control unit of the LED assembly, whereby the algorithm determines, based on a desired output of the LED assembly (e.g. determined by the input signal) if a limitation is reached and, if so, determine an appropriate control signal for the LED assembly. It is worth noting that determining whether or not a thermal limitation limits the desired output of the LED assembly, may not be straightforward. This can be illustrated by the following:

The dissipation of the power converter of an LED assembly may e.g. not only depend on the current provided by the power converter but also on the voltage over the LED fixture to which the current is supplied. In case an LED fixture comprises several LEDs connected in series, the voltage over the LED fixture may vary depending on the number of LEDs that are turned on. As such, providing a certain current to the LED fixture by the power converter may thus result in a different dissipation for a different number of LEDs that is turned on. Determining the actual dissipation of the power converter may thus require taking into account both the current to be provided and the desired output of the LED assembly (which determines which LEDs need to be turned on at which duty cycle).

As a first example of an algorithm that enables an appropriate selection of operational parameters of an LED assembly (operational parameters such as required current level or levels, duty cycles, etc. . . . ), the following can be considered.

Assuming an LED fixture comprising a number of LEDs connected in series having a nominal operating current Inom, a maximum operating current Imax (optionally depending on an operating duty cycle) and whereby the power converter can provide a maximum output voltage Vmax for powering the LED fixture. Note that these parameters of the LED assembly can e.g. be obtained from a configuration database (as e.g. described above) or can e.g. be fixed in a separate memory unit or a memory unit of a control unit of the LED assembly. In case of a modular LED assembly wherein an LED fixture is easily replaceable, it may be advantageous to provide the LED fixture with a PROM (which in use can be accessed by a control unit of the LED assembly) comprising a number of parameters of the LED fixture. Such parameters can e.g. include Inom, Imax of the LEDs of the LED fixture or the forward voltage of the different LEDs (optionally as a function of the LED current), etc. . . . .

Upon receipt of an input signal representing a required output characteristic of the LED assembly, a control unit of the LED assembly can convert the input signal into one or more control signals for the power converter or LED fixture using the parameters according to the following algorithm:

based on the input signal and the nominal current Inom, the required duty cycles for the n series connected LEDs (DC1-DCn) of the LED fixture is determined.

From the duty cycles, the required forward voltage for powering the LEDs can be determined, for any duty cycle distribution. Each LED of the LED fixture can e.g. require a forward voltage Vf of approx. 4 V.

For a given duty cycle distribution, it can be assessed if the required forward voltage can be provided by comparing the voltage with Vmax.

In case the required forward voltage exceeds Vmax, one of the following strategies can be applied:

i. Select a duty cycle distribution such that the required forward voltage remains below Vmax. By distributing the ON-times of the different LEDs in such manner that not all LEDs are turned on at the same time, the required forward voltage can be reduced. When the required output characteristic of the LED assembly (e.g. either colour or intensity) is such that such a distribution is no longer possible, a selection is made either to follow the required colour setting or the required intensity.

ii. In case of n substantially identical LEDs, the required forward voltage can be reduced by operating only n-x LEDs at the same time and increasing the LED current by a factor n/(n-x), taking into account Imax.

iii. A less favourable solution would be to reduce the LED current to such an extent that the required forward voltage of the LED reduces, thereby reducing the required forward voltage for powering the LED fixture. A drawback of this approach is that the current would have to be reduced significantly in order to obtain a forward voltage reduction. Such an approach would typically result in a colour shift as well; such a shift could however be compensated by an appropriately designed algorithm.

As a second example, the algorithm can take into account a maximum dissipation Pmax of the LED fixture.

Upon receipt of an input signal representing a required output characteristic of the LED assembly, a control unit of the LED assembly can convert the input signal into one or more control signals for the power converter or LED fixture using the parameters according to the following algorithm:

based on the input signal and the nominal current Inom, the required duty cycles for the n series connected LEDs (DC1-DCn) of the LED fixture is determined.

From the duty cycles, the nominal current Inom and the forward voltage Vf of the LEDs of the LED fixture (e.g. obtained from a read-out of a PROM of the LED fixture)

the expected dissipation of the LED fixture can be determined and compared with the maximum dissipation Pmax.

Limit the duty cycles and/or current to the LED fixture in case the Pmax is exceeded while fulfilling the user requirements as closely as possible using a predetermined strategy, e.g. considering a colour setting more important than an intensity requirement.

Regarding such a comparatively simple approach to take into account a maximum dissipation, it is worth noting that more advanced approaches taking into account the thermal properties of the LED fixture or LED assembly may be preferred.

Such a more advanced approach can e.g. include providing parameters such as a thermal resistance of the LED fixture which can e.g. comprise different components such as the thermal resistance of each LED of the fixture, the thermal resistance of the fixture to ambient, the thermal resistance towards a cooling element (if applied), etc. . . . . Regarding the latter, in order to maintain the temperature of an LED assembly below a predetermined limit, a cooling element, e.g. a passive piece of metal, a fan, a heat-pipe or other, is often applied to remove the dissipation of the LEDs of the LED fixture to the environment. The effectiveness of such cooling element may be different for different LEDs of an LED fixture. As such, the temperature of the LED assembly attained may be different depending on which LED is operated. As such, the thermal resistance of each LED towards the cooling element and/or the thermal resistance of the cooling element to the environment can be specified.

It can further be noted that an LED driver of the LED assembly can further be configured to control the cooling element as applied, e.g. based on configuration data obtained using any of the configuration methods according to the invention. As an example, the configuration data can enable the LED driver (e.g. a power converter of the LED driver) to appropriately drive a fan or heat pipe or other active cooling element. Driving the active cooling element may further be based a thermal model of the LED fixture, the actual illumination set-point for the LED fixture, or a temperature feedback from a sensor or a combination thereof.

As an alternative, or as a check or refinement of the thermal parameters, the thermal parameters describing the thermal behaviour of the LED fixture or LED assembly can be obtained from sensor (e.g. one or more temperature sensors) feedback. From a given operating condition (and thus dissipation) and temperature feedback, a thermal resistance and, optionally, thermal time constant, can be determined. As will be acknowledged by the skilled person, based on a plurality of operating conditions whereby e.g. different LEDs are operated, an accurate thermal model of the LED fixture and LED assembly can be determined, or refined.

Such a thermal model may thus be applied in the algorithm to assess whether an expected dissipation of the LED fixture, based on the required duty cycles to obtain a required output characteristic, is acceptable or not.

Note that, in case (temperature) feedback is available to the control unit of the LED assembly, the algorithm can be implemented as a controller such as a PID controller or Fuzzy-logic controller.

In a preferred embodiment, the required model (e.g. a thermal model) and/or parameters of the LED assembly and the algorithm are adjusted off line to obtain an optimal performance of the LED assembly. Once such matching or adjusting is done, the algorithm can be suitably coded and downloaded to the control unit, e.g. the control according to the invention or the control unit of an LED driver according to the invention. By matching the algorithm to the model or parameters used off-line, the size of the program that is downloaded can be kept comparatively small.

The LED driver according to the invention may also be advantageously applied in the following circumstances:

In case an LED assembly comprises different modules which can be replaced, the use of an LED driver according to the invention can be used to easily adapt to a replaced module of the assembly when the replaced module has different properties. As an example, an LED assembly can comprise an LED fixture comprising one or more LEDs, a power converter for powering the LED fixture, a cooling element for cooling the LED fixture, etc. . . . . When one of these components is replaced, the overall behaviour of the LED assembly can be affected. A new LED fixture can e.g. result in a higher brightness compared to the old LED fixture, such a new LED fixture can be more efficient (i.e. have less dissipation) or may have a different maximum continuous current, etc. . . . .

As a result, a mere replacement of a module of an LED assembly could result in the LED assembly responding in a different manner to an input signal. This may be an unwanted situation, e.g. in case the LED assembly is to respond in a similar manner as other assemblies that are not changed. On the other hand, a replacement of a module of the LED assembly may enhance the possibilities of the LED assembly, e.g. enable a different colour spectrum or an enhanced brightness.

Using a LED driver according to the invention, an algorithm can be downloaded taking into account the modifications made to the LED assembly. As such, the conversion from an input signal to a control signal can be optimised for the new arrangement of the LED assembly.

The LED driver according to the invention may also facilitate the adaptation of an LED assembly to varying properties of the input signal. Assuming an LED assembly being arranged to respond in a particular manner to a DMX input signal having a value between 0 and 255 (an 8-bit signal) thereby changing an intensity and colour output of an LED fixture of the LED assembly along a predetermined graph (e.g. as described above). In case the input signal would be changed from an 8-bit signal to a 16-bit signal (i.e. ranging from 0 to 511) an adjustment of the response of the LED assembly to the input signal would be required. When the relationship between the input signal and the response to the signal is determined by an algorithm downloaded to the control unit of the LED assembly an adjustment of the response (e.g. due to a changed input signal characteristic) of the LED assembly can be realised by downloading a modified algorithm to the control unit.

The LED driver according to the invention may also facilitate in overcoming any wiring errors or faults in e.g. a network connecting a user interface (e.g. providing the input signal) and the LED assembly. In such an arrangement, the input signal can comprise a plurality of signals originating from different data channels, each channel e.g. corresponding to an LED of an LED fixture of the LED assembly. In case an error has been made with respect to the wiring of the different channels or if the applied LED fixture has a different topology, the LED assembly may not respond to the plurality of signals as expected. Using a control unit according to the invention however, the response to the plurality of signals originating from different data channels can be modified by downloading a modified algorithm to the control unit.

Preferably, the program that is downloaded to the control unit of the LED driver is downloaded using wireless communication. In case the input signal is also provided to the control unit via wireless communication, the program is preferably provided to the control unit using the same interface (e.g. receiver) as applied for receiving the input signal.

The LED driver according to the invention thus enables an LED assembly to be controlled via an input signal in a flexible manner. The LED driver according to the invention enables the operation of the LED assembly to be optimised for varying circumstances such as changes to the input signal or changes to the LED assembly.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language, not excluding other elements or steps). Any reference signs in the claims should not be construed as limiting the scope of the claims or the invention.

The mere fact that certain measures are recited in mutually different dependent claims does not indicate that a combination of these measures cannot be used to advantage.

The term coupled, as used herein, is defined as connected, although not necessarily directly, and not necessarily mechanically.

A single processor or other unit may fulfil the functions of several items recited in the claims.

The invention claimed is:

1. A method of configuring an LED driver, the LED driver to provide a supply power to an LED fixture comprising a plurality of LEDs, the method comprising:

identifying the LED fixture;

obtaining, using the identification of the LED fixture, configuration data for the LED driver from a configuration database; and configuring the LED driver according to the configuration data;

wherein the configuration data comprises a meta code, and wherein configuring the LED driver comprises:

decoding the meta code into LED driver specific configuration data; and configuring the LED driver according to the LED driver specific configuration data.

2. The method according to claim 1, wherein obtaining the configuration data comprises:

sending via a communication network a configuration request to a configuration database, and receiving configuration data from the configuration database.

3. The method according to claim 1, wherein identifying the LED fixture comprises:

detecting by the LED driver an electrical signal obtained via the LED fixture; and deriving by the LED driver an LED fixture identification code from the obtained electrical signal.

4. The method according to claim 3, wherein the configuration data is obtained using the LED fixture identification code.

5. The method according to claim 2, further comprising:

identifying the LED driver; and wherein the configuration request comprises an identification of the LED driver.

6. The method according to claim 1 further comprising:

identifying the LED driver; and obtaining, using the identification of the LED driver, configuration data for the LED driver from a configuration database.

7. The method according to claim 1, wherein the step of configuring the LED driver comprises: decoding by a Lookup table the configuration data into LED driver settings, and configuring the LED driver according to the LED driver settings.

8. The method according to claim 1, further comprising:

providing a feedback signal from the LED fixture to the LED driver, and reconfiguring the LED driver according to the feedback signal.

9. The method according to claim 1, wherein configuring the LED driver comprises:

determining from the configuration data an LED driver setting comprising one or more of a power limit per LED or LED group, a total power limit for the LED fixture, and an LED fixture total power limit reduction, and setting the LED driver in accordance with the determined configuration data.

10. An LED driver comprising a power converter for powering an LED fixture and a control unit for controlling the power converter and/or the LED fixture, and wherein the LED driver is configured according to the method of claim 1.

11. An LED driver comprising a power converter for powering an LED fixture comprising a plurality of LEDs and a control unit for controlling the power converter and/or the LED fixture, and wherein the LED driver is configured for:

identifying the LED fixture;

obtaining, using the identification of the LED fixture, configuration data for the LED driver from a configuration database; and configuring the LED driver according to the configuration data;

wherein the control unit comprises:

an input terminal for receiving an input signal, an output terminal for providing an output signal to the power converter and/or the LED fixture for controlling the power converter and/or the LED fixture, and wherein the control unit is further arranged to:

receive, by means of a download, a program comprising an algorithm for converting the input signal to the control signal for the power converter and/or the LED fixture and following receipt of the program, establish a conversion from the input signal to the output signal using the algorithm.

12. The LED driver according to claim 11 wherein the algorithm is based on one or more parameters of the power converter and/or the LED fixture and/or environmental parameters.

13. The LED driver according to claim 11 wherein the control unit is further arranged to compile or interpret the downloaded program to an executable program, executable by the control unit.

14. The LED driver according to claim 11 wherein the input signal comprises a DMX signal.

15. The LED driver according to claim 11 wherein the control signal represents a desired colour and/or intensity set point of the LED fixture.

16. The LED driver according to claim 11 wherein the input signal comprises a plurality of signals originating from different data channels and wherein the control signal comprises a plurality of signals for controlling a plurality of illumination parameters of the LED fixture.

17. The LED driver according to claim 11 wherein the program is downloaded to the control unit using wireless communication.

18. The LED driver according to claim 11 wherein the program is received via the input terminal.

19. The LED driver according to claim 12, wherein the one or more parameters are provided to the control unit via the downloaded program.

20. The LED driver according to claim 11 wherein the algorithm comprises a model such as a thermal or electric model, of the power converter and/or the LED fixture.

21. The LED driver according to claim 11 wherein the algorithm further enables to determine a one-to-one relationship between the input signal and the control signal over an entire range of the input signal.

22. The LED driver according to claim 10 wherein the control unit is arranged to determine an output signal for the power converter or LED fixture based on the configuration data.

23. An LED assembly comprising:

an LED fixture comprising at least one LED, an LED driver according to claim 12, wherein the one or more parameters comprise at least one parameter of the LED fixture and at least one parameter of the power converter.

24. The LED assembly according to claim 23 wherein the one or more parameter comprises at least one parameter describing a thermal characteristic of the LED assembly.

25. The LED assembly according to claim 23 further comprising a cooling element for cooling the LED fixture and/or the power converter and wherein the one or more parameters further comprise at least one parameter of the cooling element.

26. A method of controlling an LED assembly, the LED assembly comprising:

an LED fixture comprising at least one LED, an LED driver comprising a power converter for providing a supply power to the LED fixture, and a control unit for controlling the power converter and/or the LED fixture, the method comprising the steps of:

receiving an algorithm applying one or more parameters of the LED assembly and or environmental parameters for determining a control signal value from an input signal value by downloading a program to the control unit, receiving an input signal by the control unit, converting an input signal value of the input signal to a control signal value using the algorithm, and controlling the power converter and/or LED fixture of the LED assembly using the control signal value, wherein the LED driver is configured according to claim 1 and wherein the one or more parameters comprise the configuration data.

* * * * *